US007743938B2

(12) United States Patent
Wu

(10) Patent No.: US 7,743,938 B2
(45) Date of Patent: Jun. 29, 2010

(54) BOX ASSEMBLY

(75) Inventor: Chin-Chuan Wu, Tao-Yuan Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 1388 days.

(21) Appl. No.: 11/131,400

(22) Filed: May 17, 2005

(65) Prior Publication Data

US 2006/0144840 A1 Jul. 6, 2006

(30) Foreign Application Priority Data

Jan. 6, 2005 (TW) ..... 94100358 A

(51) Int. Cl.
*B65D 1/24* (2006.01)
*B65D 25/04* (2006.01)
*B65D 85/30* (2006.01)

(52) U.S. Cl. ..... 220/507; 220/527; 220/528; 220/533; 206/205; 206/722

(58) Field of Classification Search ..... 220/507, 220/527, 528, 533; 206/205, 709, 722, 725, 206/1.5, 495
See application file for complete search history.

(56) References Cited

U.S. PATENT DOCUMENTS 4,832,612 A * 5/1989 Grabbe et al. ..... 439/71
5,201,415 A * 4/1993 Metz ..... 206/707
5,337,893 A * 8/1994 Nami et al. ..... 206/722
5,370,225 A * 12/1994 Corey et al. ..... 206/722
5,415,286 A * 5/1995 Marchek et al. ..... 206/722
5,454,478 A * 10/1995 Everson ..... 220/23.83
5,487,471 A * 1/1996 Marchek et al. ..... 206/725
5,579,941 A * 12/1996 Romick ..... 220/23.86
5,695,068 A * 12/1997 Hart et al. ..... 206/725
5,823,424 A * 10/1998 Allen ..... 229/120.07
6,145,663 A * 11/2000 Kim et al. ..... 206/454
7,011,214 B2 * 3/2006 Brackmann et al. ..... 206/509
7,175,024 B2 * 2/2007 Fankhauser et al. ..... 206/486
7,435,099 B2 * 10/2008 Kirkus ..... 439/66
2003/0066780 A1 * 4/2003 Zabka et al. ..... 206/710
2004/0104138 A1 * 6/2004 Remaks ..... 206/386
2005/0269241 A1 * 12/2005 Brooks et al. ..... 206/710
2006/0000747 A1 * 1/2006 Wright et al. ..... 206/710

* cited by examiner

*Primary Examiner*—Anthony Stashick
*Assistant Examiner*—Niki M Eloshway
(74) *Attorney, Agent, or Firm*—Frommer Lawrence & Haug LLP; Ronald R. Santucci

(57) ABSTRACT

A box assembly includes a box unit having a box body, and a plurality of spaced apart limiting members. The box body is formed with a plurality of spaced apart positioning elements, and defines an inner space therein. The limiting members are disposed in the inner space, and are connected detachably and respectively to the positioning elements so as to be adapted to limit at least one panel thereamong.

2 Claims, 21 Drawing Sheets

BOX ASSEMBLY

CROSS-REFERENCE TO RELATED APPLICATION

This application claims priority of Taiwanese Application No. 094100358, filed on Jan. 6, 2005.

BACKGROUND OF THE INVENTION

1. Field of the Invention

This invention relates to a box assembly, more particularly to a box assembly that includes a box body formed with a plurality of positioning elements, and a plurality of limiting members that are connected detachably and respectively to the positioning elements for limiting at least one display panel thereamong.

2. Description of the Related Art

FIG. 1 illustrates a conventional box unit 9 for receiving liquid crystal display (LCD) panels therein so as to facilitate transport of the display panels from one working station to the next working station during processing of the LCD panels. The box assembly 9 includes a box body 91, and a cover 92 for covering a top opening in the box body 91. The box body 91 defines an accommodating space 93 therein, and has two opposite inner wall surfaces 911 that are formed with a plurality of pairs of ribs 912 which define a plurality of slots 94, each of which is adapted to receive an LCD panel 8.

As illustrated in FIG. 2, a plurality of the box units 9 can be stacked together on a support stand 96, and tied together using a plurality of straps 95. The assembly is then enclosed by protective paper panels 97, followed by tying with straps 98 on the protective paper panels 97.

The conventional box unit 9 is disadvantageous in that the box body 91 can accommodate only one single size of the LCD panels 8. As a consequence, different molds are required for manufacturing the box units 9 having different sizes, which results in an increase in manufacturing costs.

SUMMARY OF THE INVENTION

The object of the present invention is to provide a box assembly that is capable of overcoming the aforesaid drawback of the prior art.

According to this invention, there is provided a box assembly that comprises a box unit including a box body, and a plurality of spaced apart limiting members. The box body is formed with a plurality of spaced apart positioning elements, and defines an inner space therein. The limiting members are disposed in the inner space, and are connected detachably and respectively to the positioning elements so as to be adapted to limit at least one panel thereamong.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
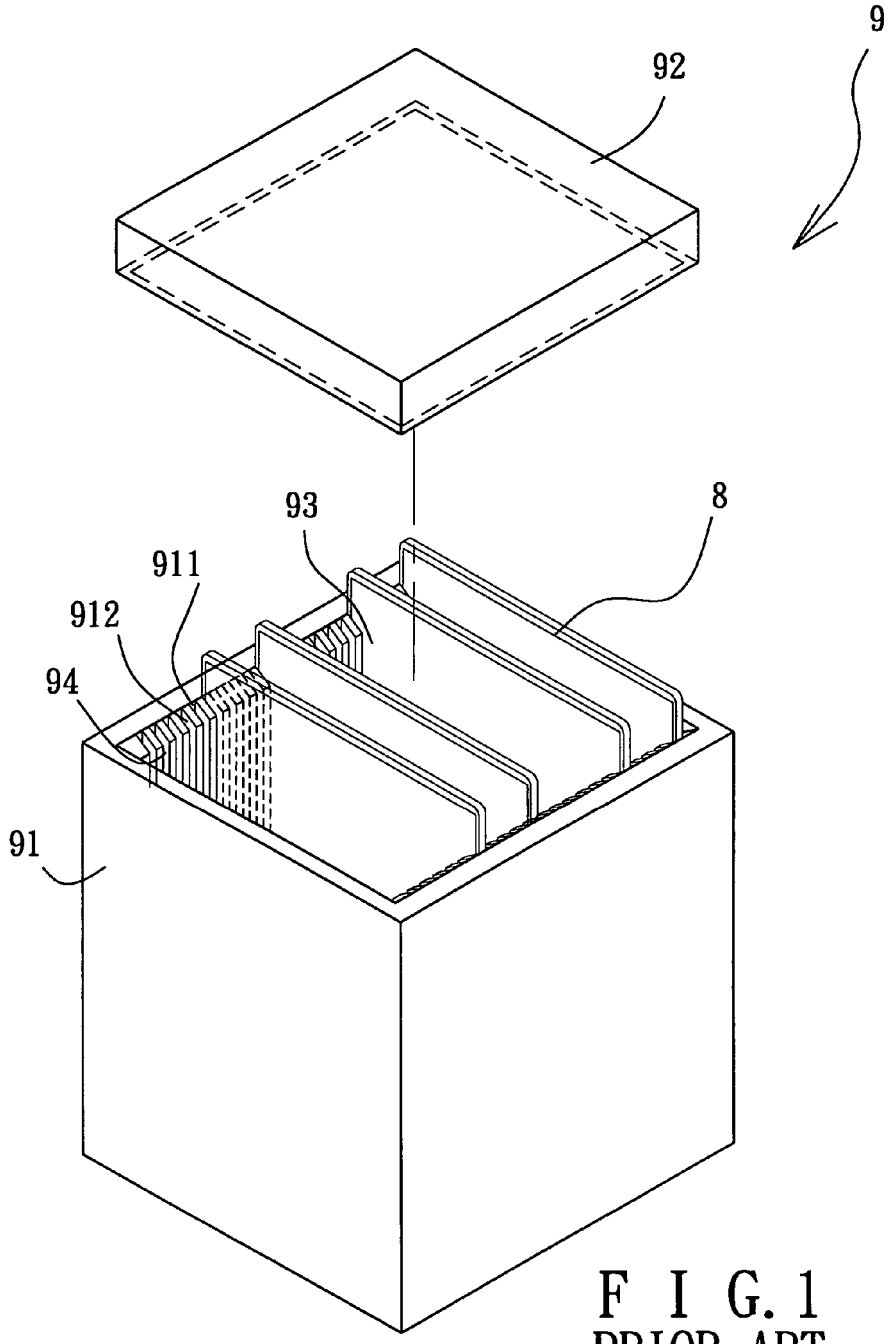
F I G. 1 PRIOR ART
FIG. 1 is an exploded perspective view of a conventional box unit.
Figure 2:
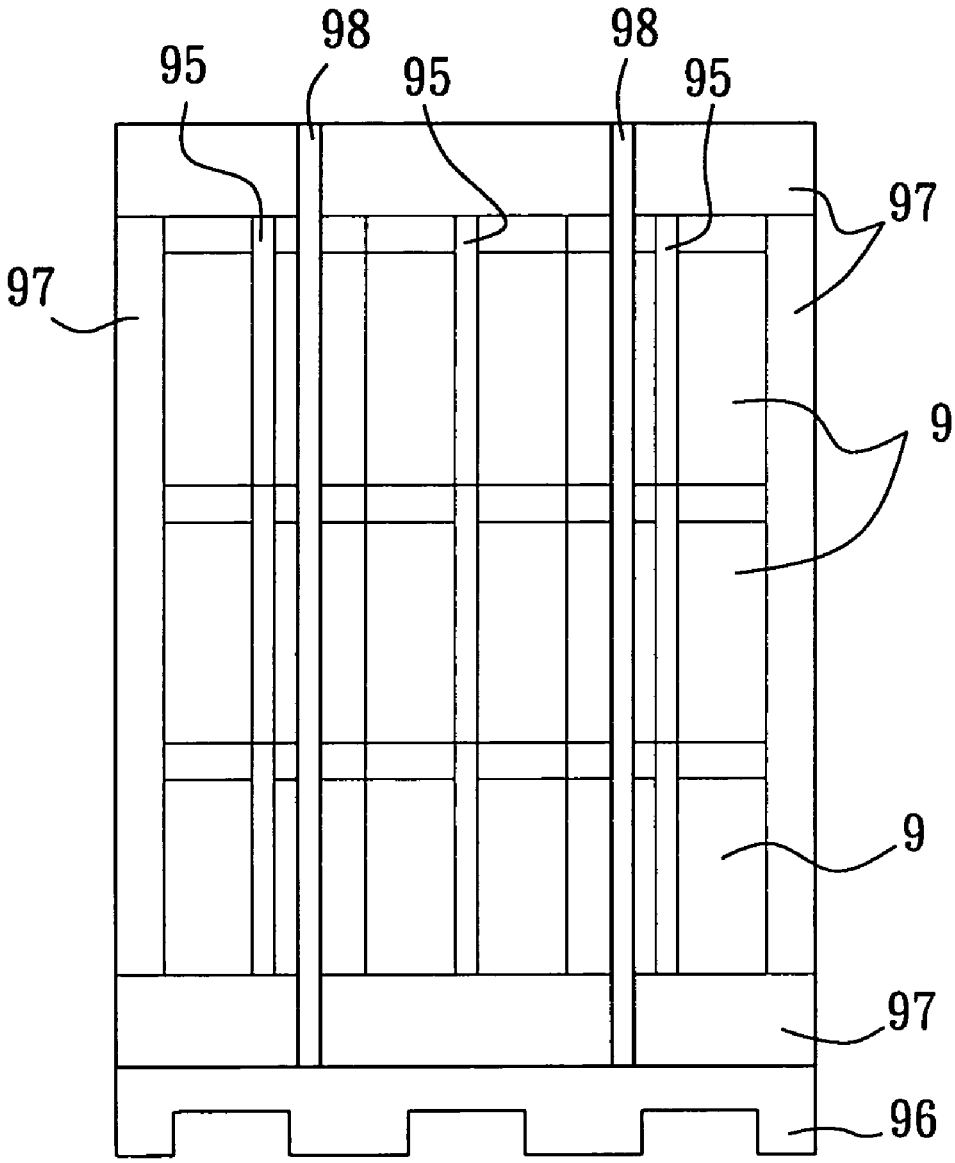
F I G. 2 PRIOR ART
FIG. 2 is a schematic view of an assembly of a plurality of the conventional box units stacked on a stand.
Figure 3:
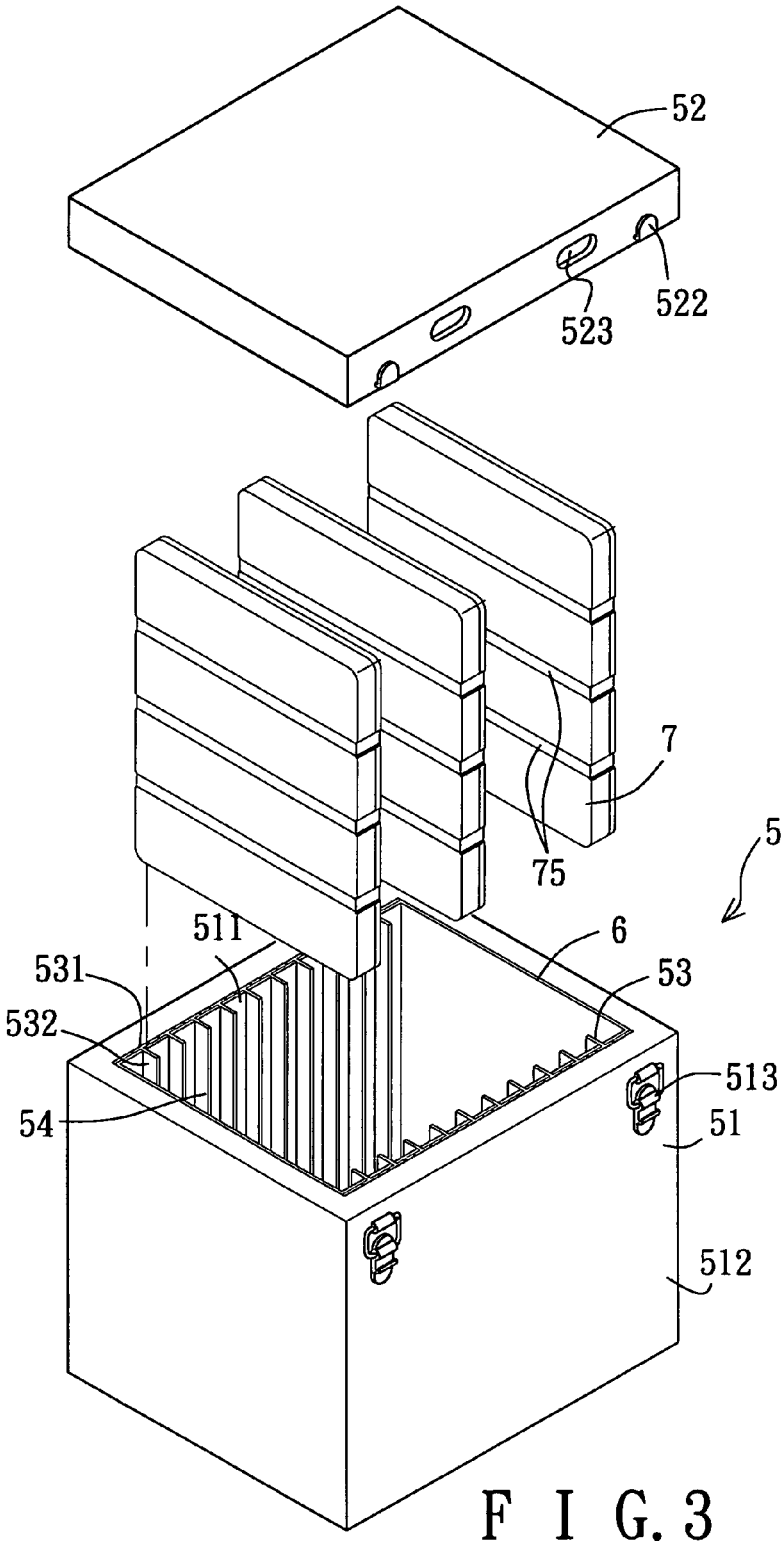
FIG. 3 is an exploded perspective view of the preferred embodiment of a box assembly according to this invention.
Figure 4:
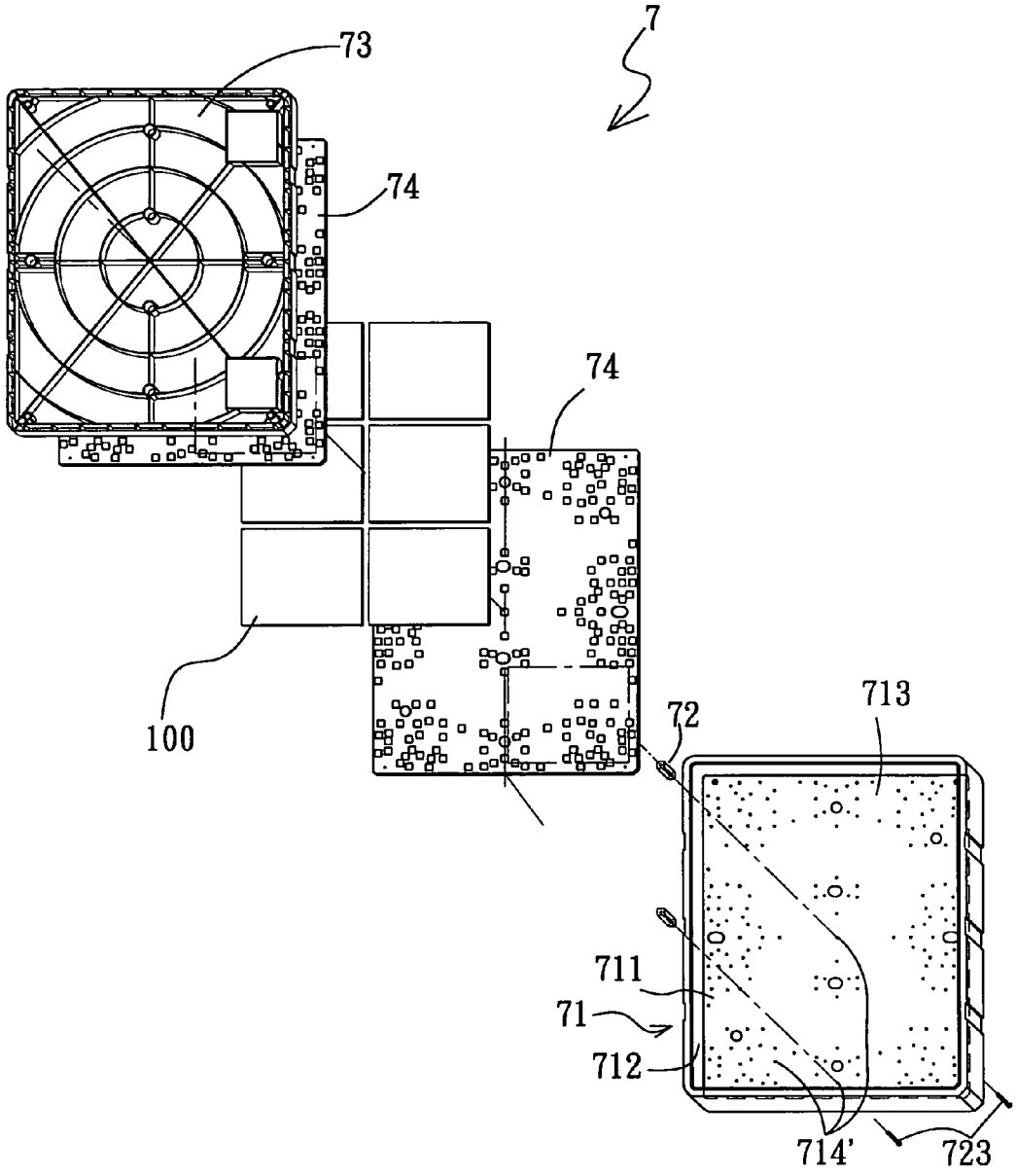
FIG. 4 is an exploded perspective view of a box unit of the preferred embodiment according to this invention.
Figure 5:
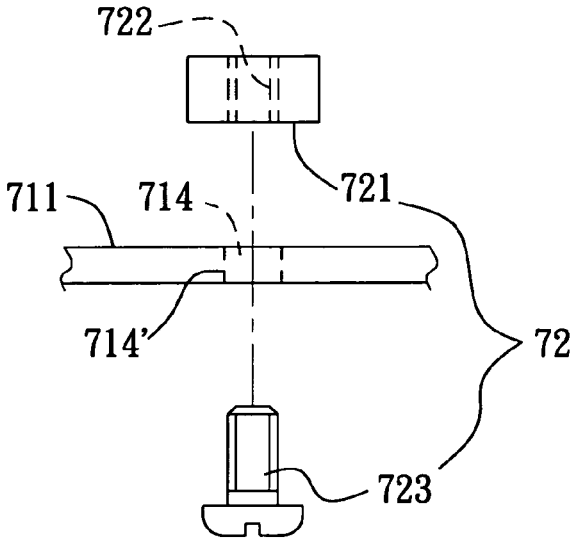
FIG. 5 is a fragmentary schematic view of a limiting member of the preferred embodiment according to this invention.

FIGS. 3 to 6 illustrate the preferred embodiment of a box assembly for accommodating display panels, such as monitor display panels and TV display panels, therein according to the present invention. The panels can be plasma display panels, electroluminescence (EL) display panels, or surface-conduction electro-emitter (SED) display panels.

The box assembly includes an outer box unit 5 and a plurality of inner box units 7. The outer box unit 5 includes an outer cover 52 and an outer box body 51 having an outer wall surface 512 and an inner wall surface 511 that is formed with two opposite rows of ribs 53 which define a plurality of box-receiving spaces 54 thereamong. Each of the ribs 53 has a T-shaped cross-section. A cushioning member 6 is attached to the inner wall surface 511 of the outer box body 51. The outer wall surface 512 of the outer box body 51 is formed with a plurality of first engaging elements 513. The outer cover 52 is formed with a plurality of second engaging elements 522 that are respectively engageable with the first engaging elements 513 so as to fasten the outer cover 52 to the outer box body 51, and a plurality of holding elements 523 which are in the form of holes for facilitating holding of the box assembly.

Each of the inner box units 7 is received in a respective one of the box-receiving spaces 54, and includes an inner cover 73, an inner box body 71, and a plurality of spaced apart limiting members 72. The inner box body 71 defines an inner space 713 therein, and includes a base wall 711 that is formed with a plurality of spaced apart positioning elements 714' and that confines a bottom side of the inner space 713, and a peripheral wall 712 that is transverse to and that extends from the base wall 711. The limiting members 72 are disposed in the inner space 713, and are connected detachably and respectively to the positioning elements 714' so as to be adapted to limit at least one panel 100 thereamong. The inner box body 71 is preferably made from an anti-static material, such as Acrylonitrile-Butadiene-Styrene.

In this embodiment, each of the positioning elements 714' defines a through-hole 714 formed in the inner box body 71. Each of the limiting members 72 includes a post 721 that is disposed on the base wall 711 of the inner box body 71 within the inner space 713 in the inner box body 71 and that is formed with an inner thread 722 aligned with the through-hole 714 of a respective one of the positioning elements 714', and a threaded member 723 that extends through the through-hole 714 of a respective one of the positioning elements 714' and that engages threadedly the inner thread 722 of the post 721 of a respective one of the limiting members 72. Alternatively, the positioning elements 714' can be in the form of recesses, and the limiting members 72 can be rods that are inserted fittingly and respectively into the recesses.

The inner cover 73 is preferably made from the anti-static material, and is preferably formed with a plurality of reinforcing ribs so as to increase the structural strength thereof.

Figure 6:
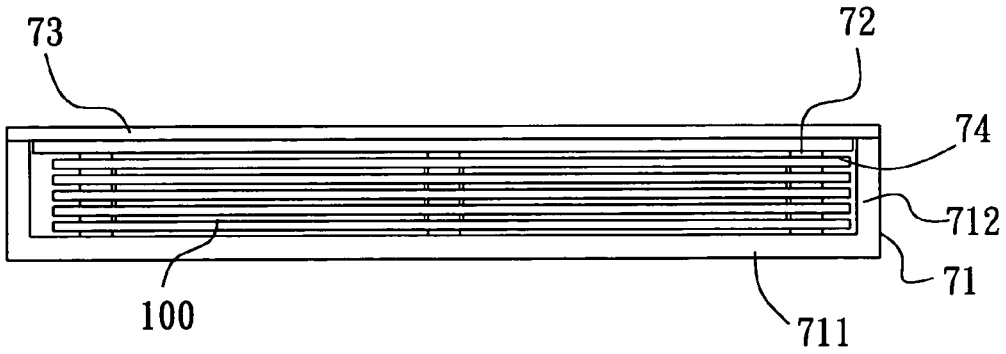
FIG. 6 is a schematic view to illustrate how a plurality of panels are stacked in the box unit of the preferred embodiment.

As illustrated in FIG. 6, a cushioning pad 74 is attached to two adjacent layers of panels 100 received in the box body 71 so as to provide a cushioning effect on the panels 100. A plurality of straps 75 (see FIG. 3) are used to tighten the inner cover 73 to the inner box body 71.

Figure 7:
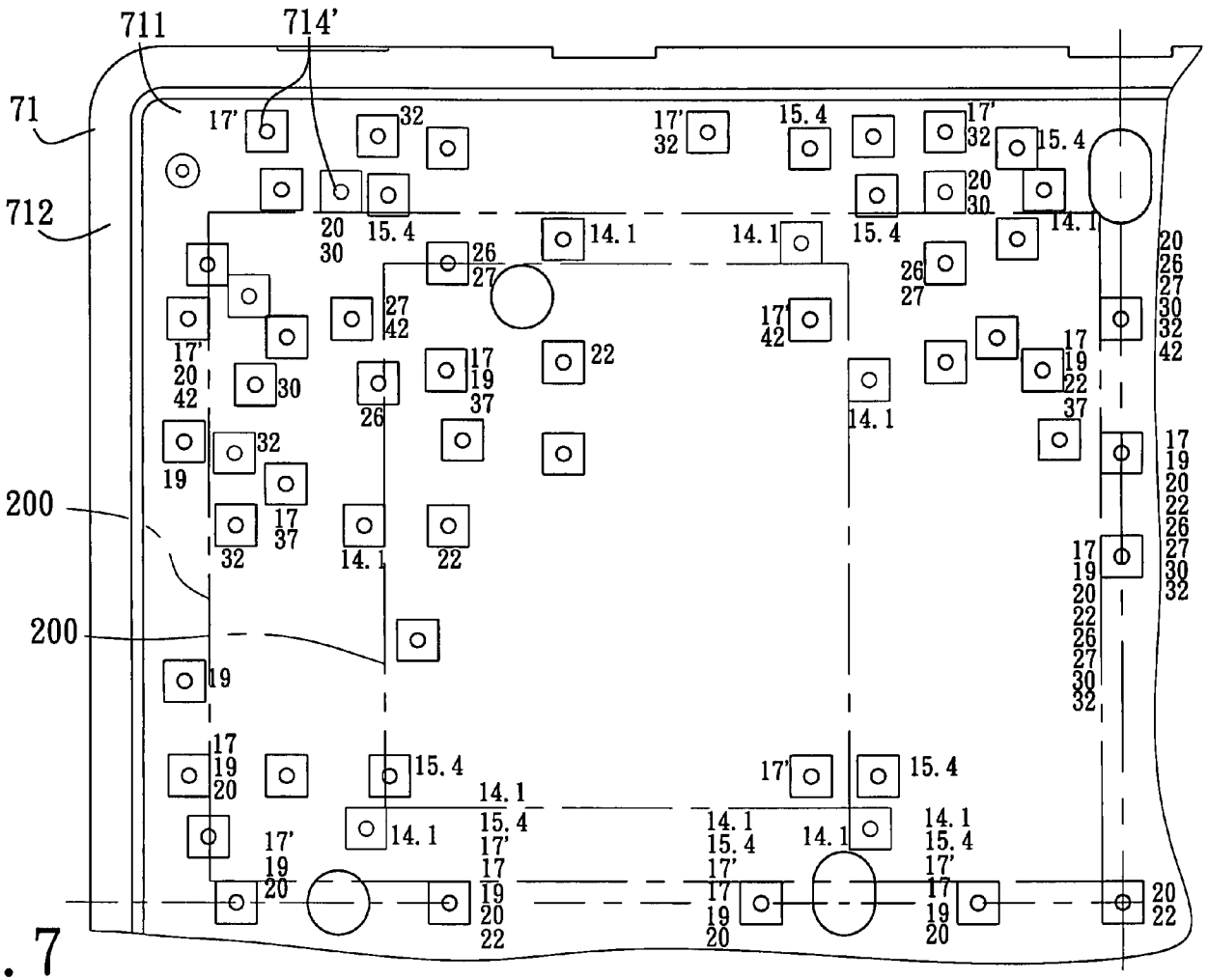
FIG. 7 is a fragmentary schematic view of a box body of the box unit of the preferred embodiment.

Referring to FIG. 7, the positioning elements 714' can be arranged into a plurality of confining patterns, which define confining regions 200, respectively. Each of the confining regions 200 includes rows and/or columns of the positioning elements 714' which are marked respectively with reference numerals 14.1, 15.4, 17, 17', 19, 20, 22, 26, 27, 30, 32, 37, and 42. The confining regions 200 are different in size so as to enable the limiting members 72 that are respectively connected to the confining patterns of the positioning elements 714' to limit the panels 100 of different sizes within the confining regions 200, respectively. For instance, each of the confining regions 200 of one of the confining patterns, which includes two parallel rows and two parallel columns of the positioning elements 714' that are marked with reference numeral 14.1, has an area substantially the same as the size of a 14.1-inch display panel.

Figure 8:
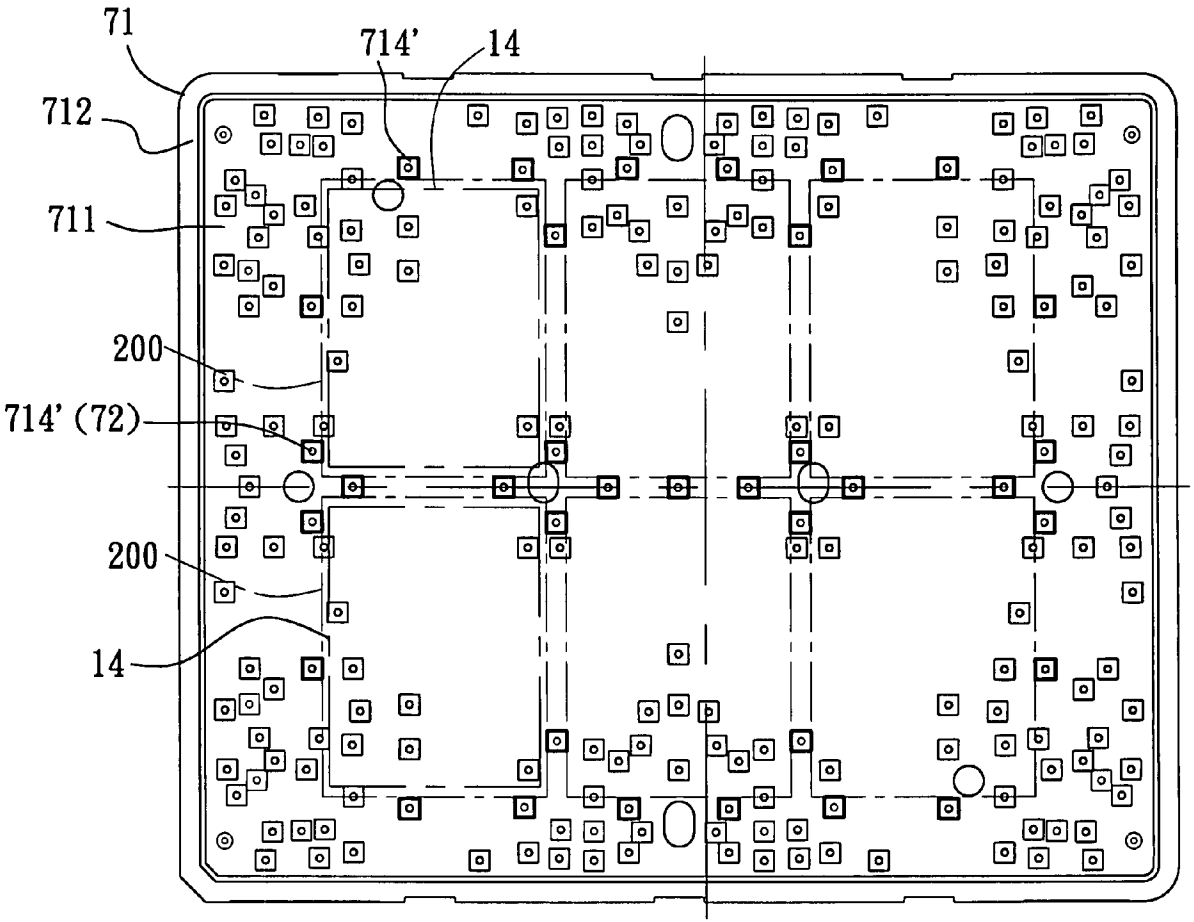
FIG. 8 is a schematic view to illustrate how a plurality of 14.1-inch display panels can be mounted in the box body of the box unit of the preferred embodiment according to this invention.

FIG. 8 illustrates how the inner box body 71 of each of the inner box units 7 accommodates six 14.1-inch display panels 14 (294.8 mm×223.3 mm) which are limited within the confining regions 200 of a respective one of the confining patterns by the limiting members 72.

Figure 9:
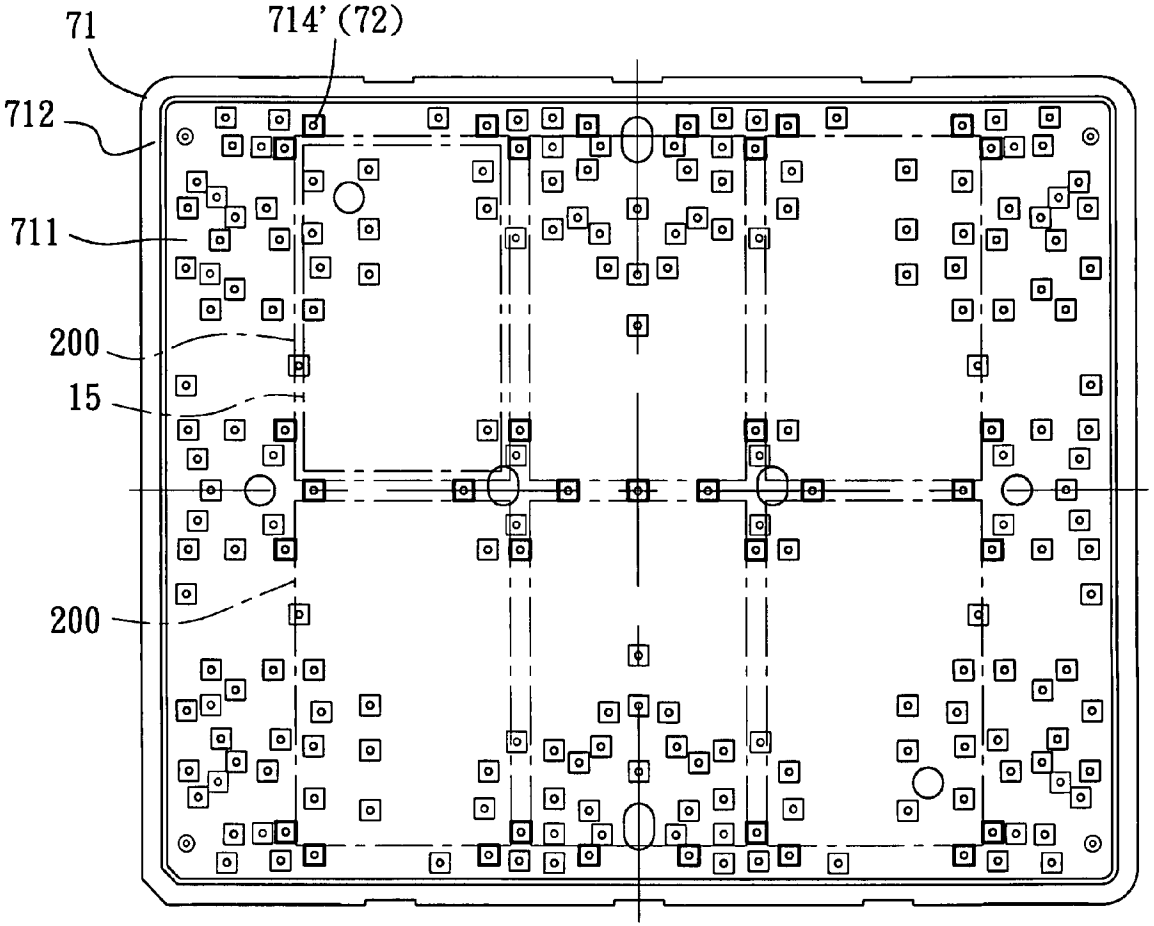
FIG. 9 is a schematic view to illustrate how a plurality of 15.4-inch display panels can be mounted in the box body of the box unit of the preferred embodiment according to this invention.

FIG. 9 illustrates how the inner box body 71 of each of the inner box units 7 accommodates six 15.4-inch display panels 15 (240.2 mm×215.6 mm) which are limited within the confining regions 200 of a respective one of the confining patterns by the limiting members 72.

Figure 10:
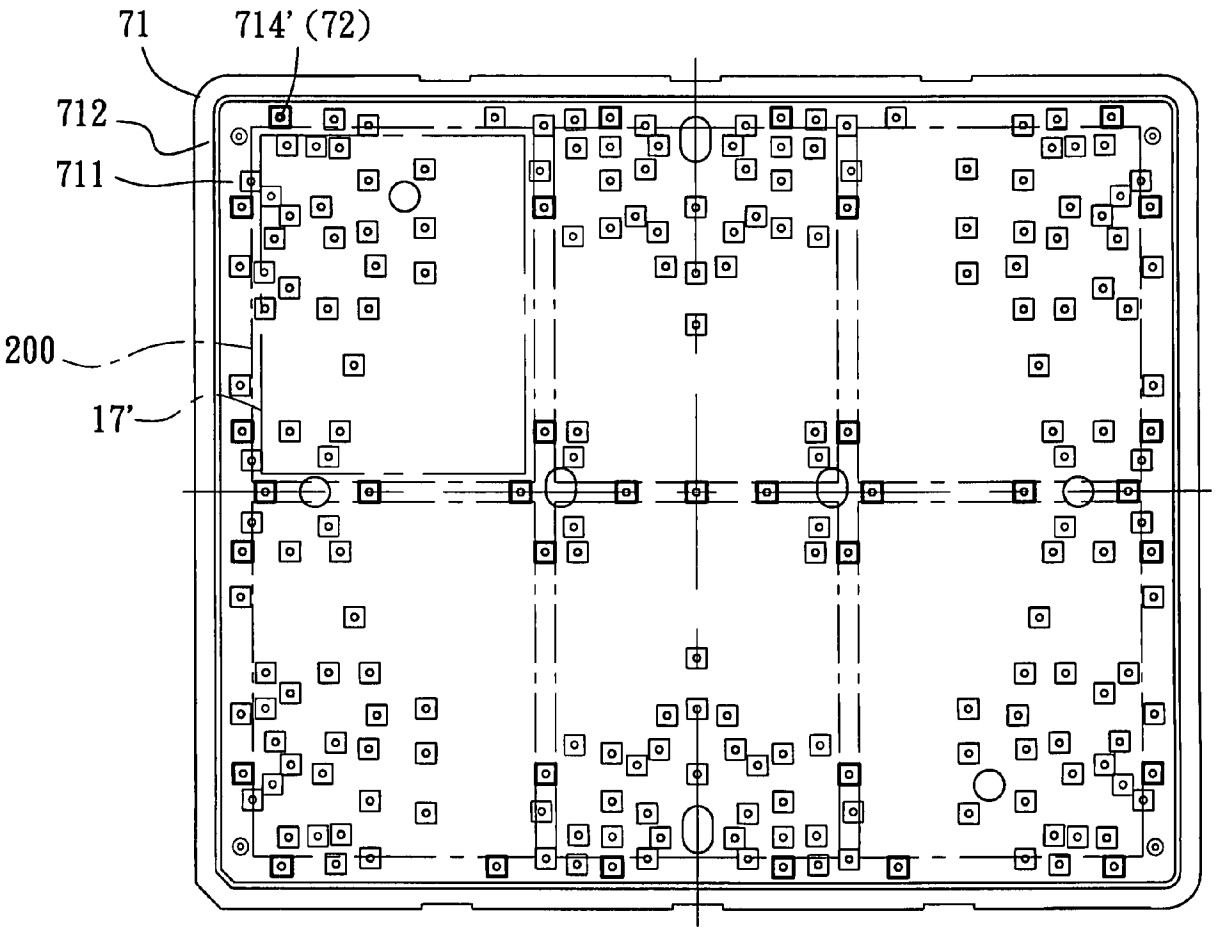
FIG. 10 is a schematic view to illustrate how a plurality of 17-inch monitor display panels (348.1 mm×280.6 mm) can be mounted in the box body of the box unit of the preferred embodiment according to this invention.

FIG. 10 illustrates how the inner box body 71 of each of the inner box units 7 accommodates six 17-inch monitor display panels 17' (348.1 mm×280.6 mm) which are limited within the confining regions 200 of a respective one of the confining patterns by the limiting members 72.

Figure 11:
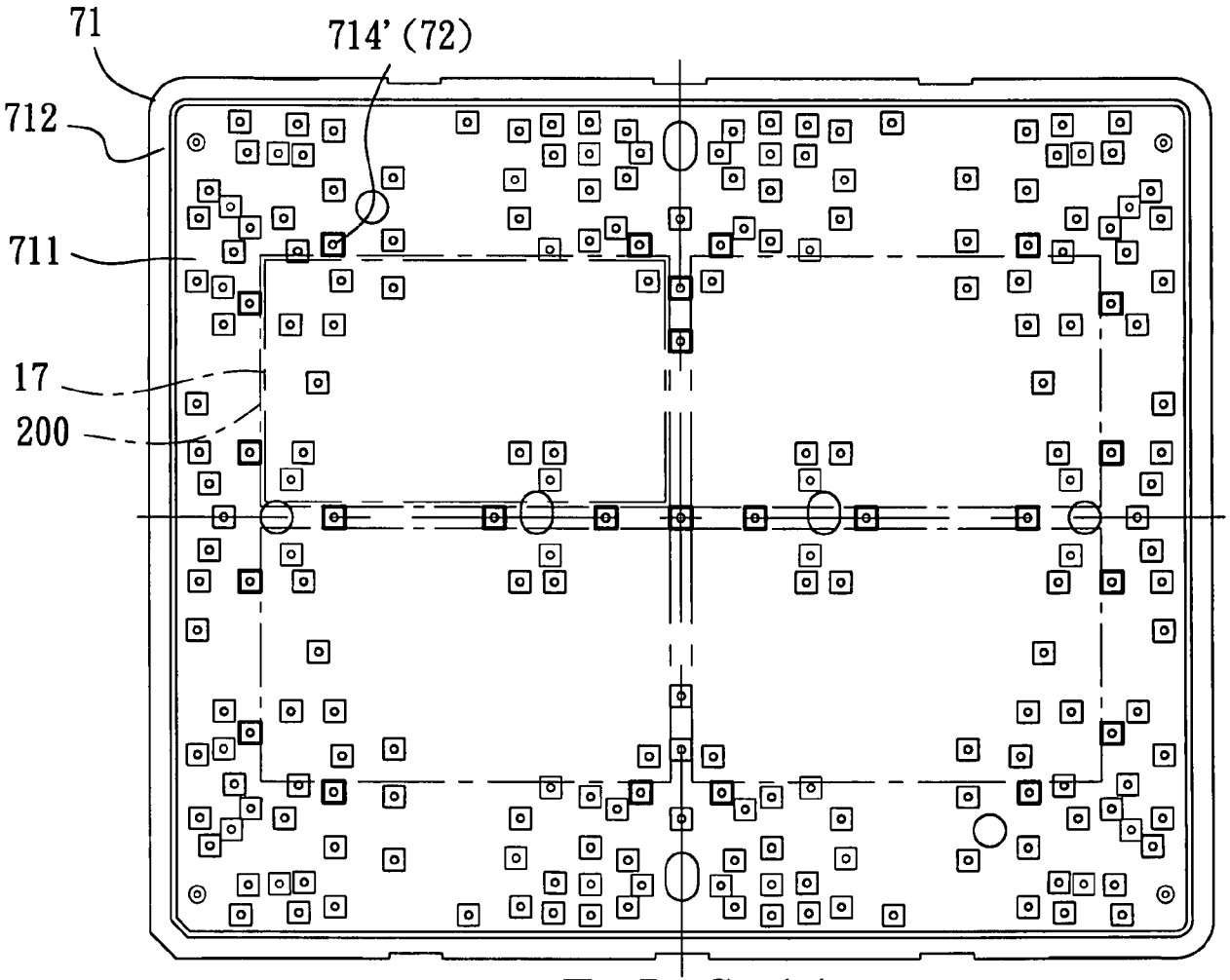
FIG. 11 is a schematic view to illustrate how a plurality of 17-inch TV display panels (384.1 mm×233.95 mm) can be mounted in the box body of the box unit of the preferred embodiment according to this invention.

FIG. 11 illustrates how the inner box body 71 of each of the inner box units 7 accommodates four 17-inch TV display panels 17 (348.1 mm×233.95 mm) which are limited within the confining regions 200 of a respective one of the confining patterns by the limiting members 72.

Figure 12:
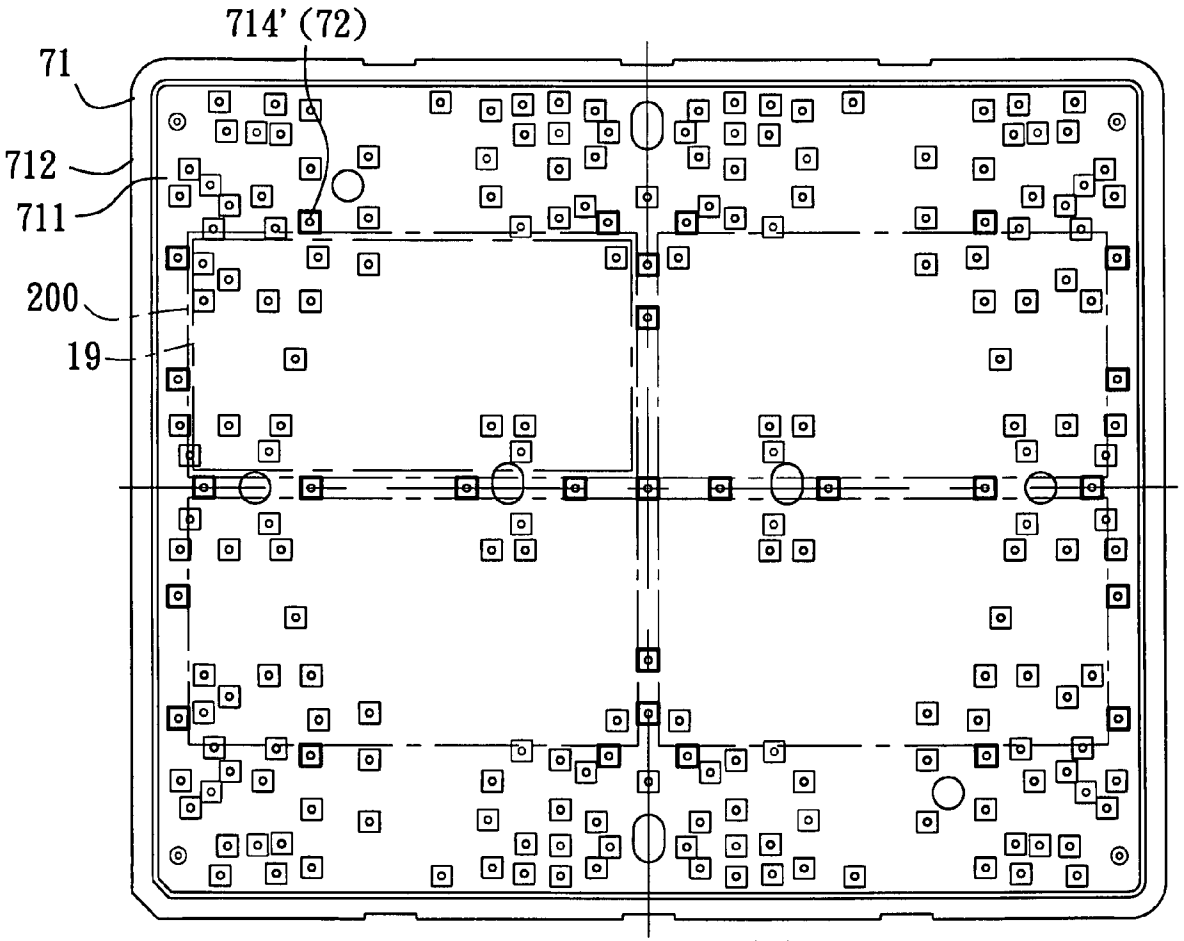
FIG. 12 is a schematic view to illustrate how a plurality of 19-inch display panels can be mounted in the box body of the box unit of the preferred embodiment according to this invention.

FIG. 12 illustrates how the inner box body 71 of each of the inner box units 7 accommodates four 19-inch display panels 19 (433.5 mm×249.54 mm) which are limited within the confining regions 200 of a respective one of the confining patterns by the limiting members 72.

Figure 13:
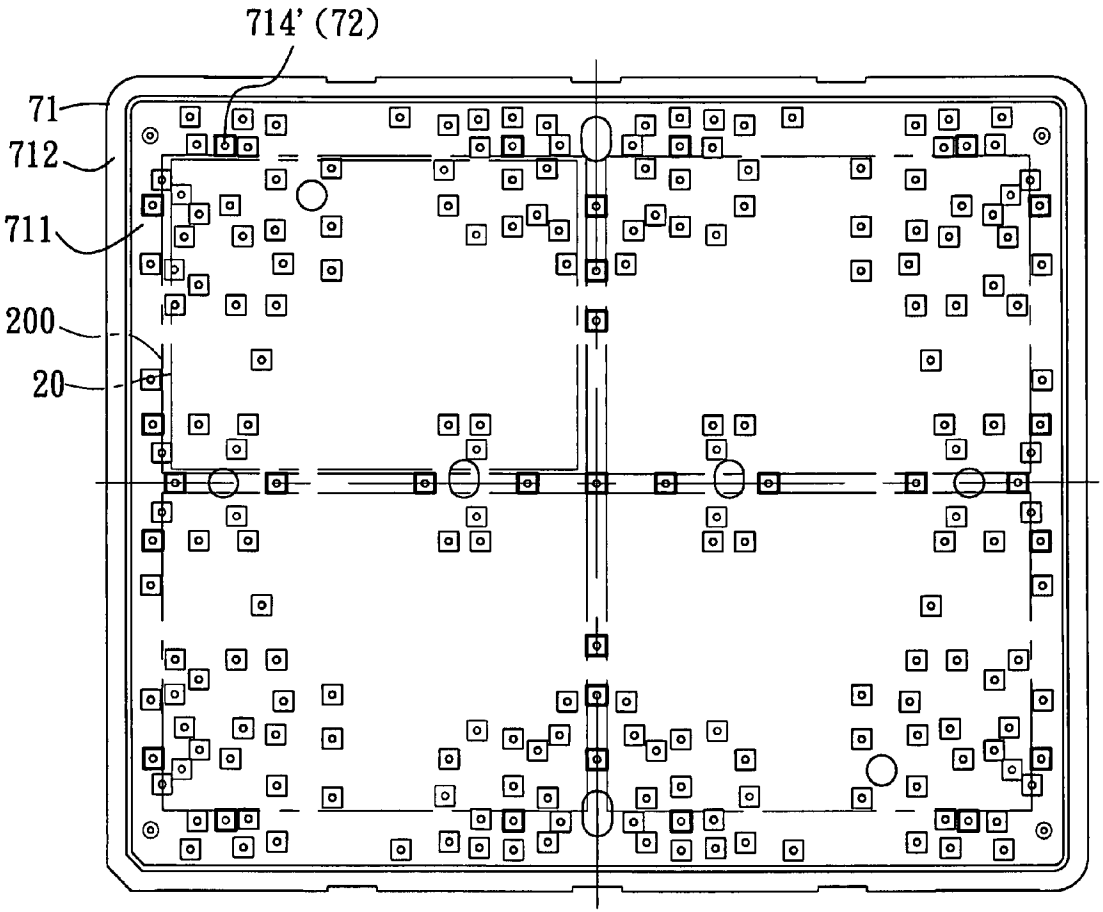
FIG. 13 is a schematic view to illustrate how a plurality of 20-inch display panels can be mounted in the box body of the box unit of the preferred embodiment according to this invention.

FIG. 13 illustrates how the inner box body 71 of each of the inner box units 7 accommodates four 20-inch display panels 20 (422 mm×320 mm) which are limited within the confining regions 200 of a respective one of the confining patterns by the limiting members 72.

Figure 14:
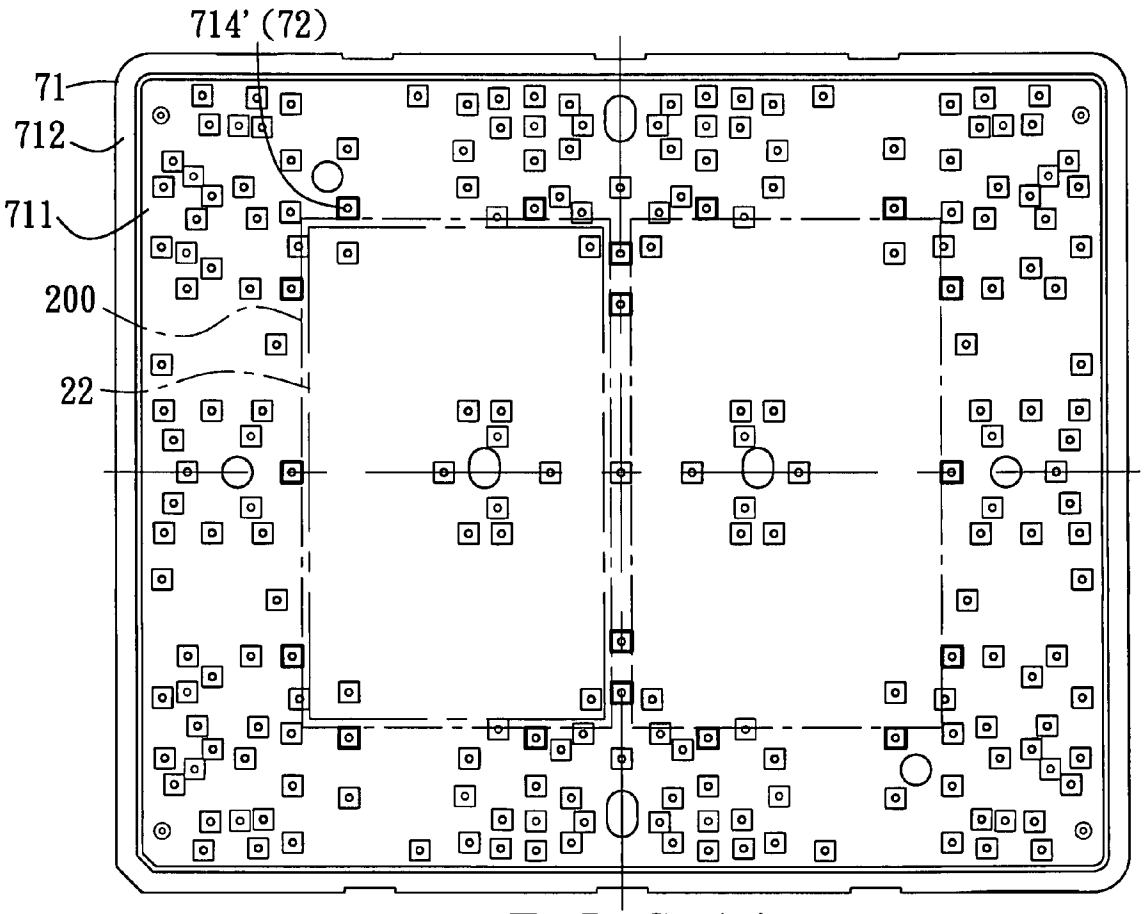
FIG. 14 is a schematic view to illustrate how a plurality of 22-inch display panels can be mounted in the box body of the box unit of the preferred embodiment according to this invention.

FIG. 14 illustrates how the inner box body 71 of each of the inner box units 7 accommodates two 22-inch display panels 22 (497 mm×305 mm) which are limited within the confining regions 200 of a respective one of the confining patterns by the limiting members 72.

Figure 15:
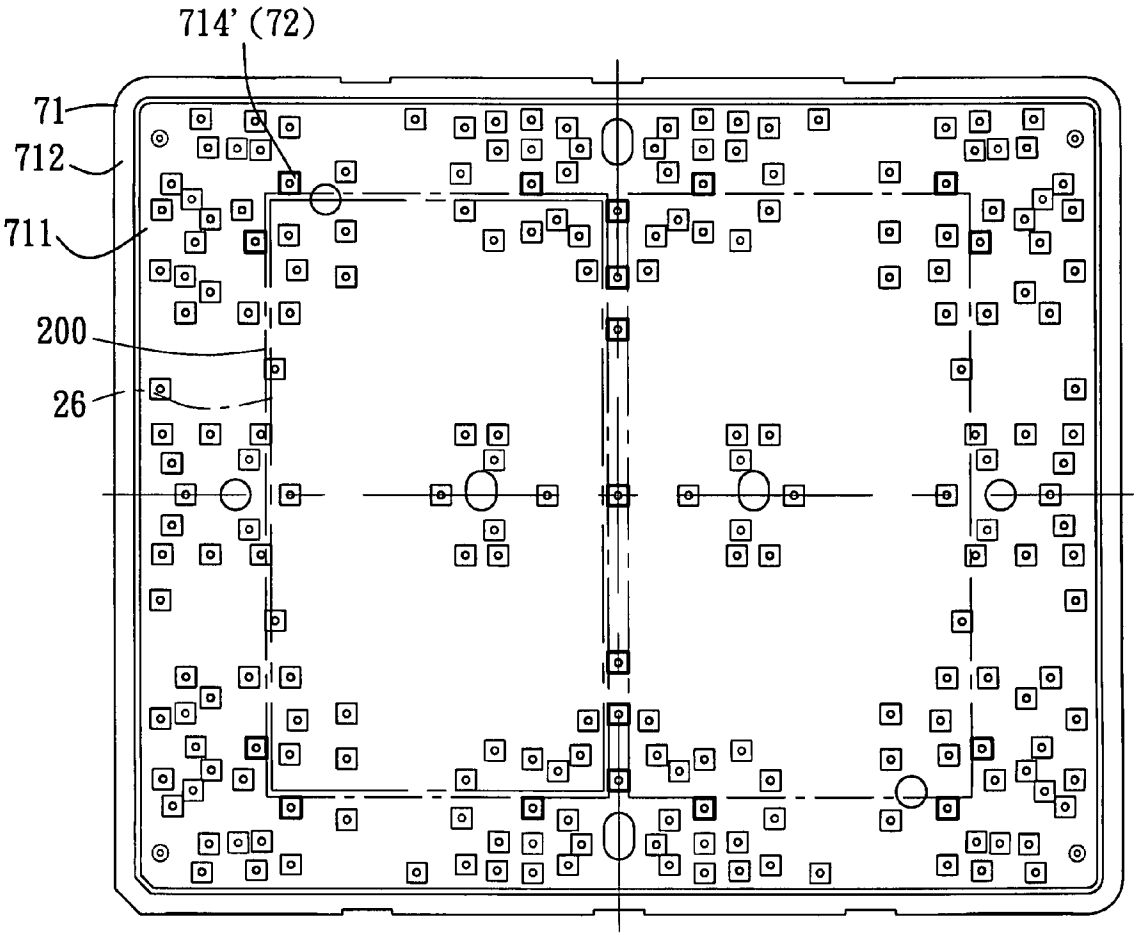
FIG. 15 is a schematic view to illustrate how a plurality of 26-inch display panels can be mounted in the box body of the box unit of the preferred embodiment according to this invention.

FIG. 15 illustrates how the inner box body 71 of each of the inner box units 7 accommodates two 26-inch display panels 26 (591 mm×339 mm) which are limited within the confining regions 200 of a respective one of the confining patterns by the limiting members 72.

Figure 16:
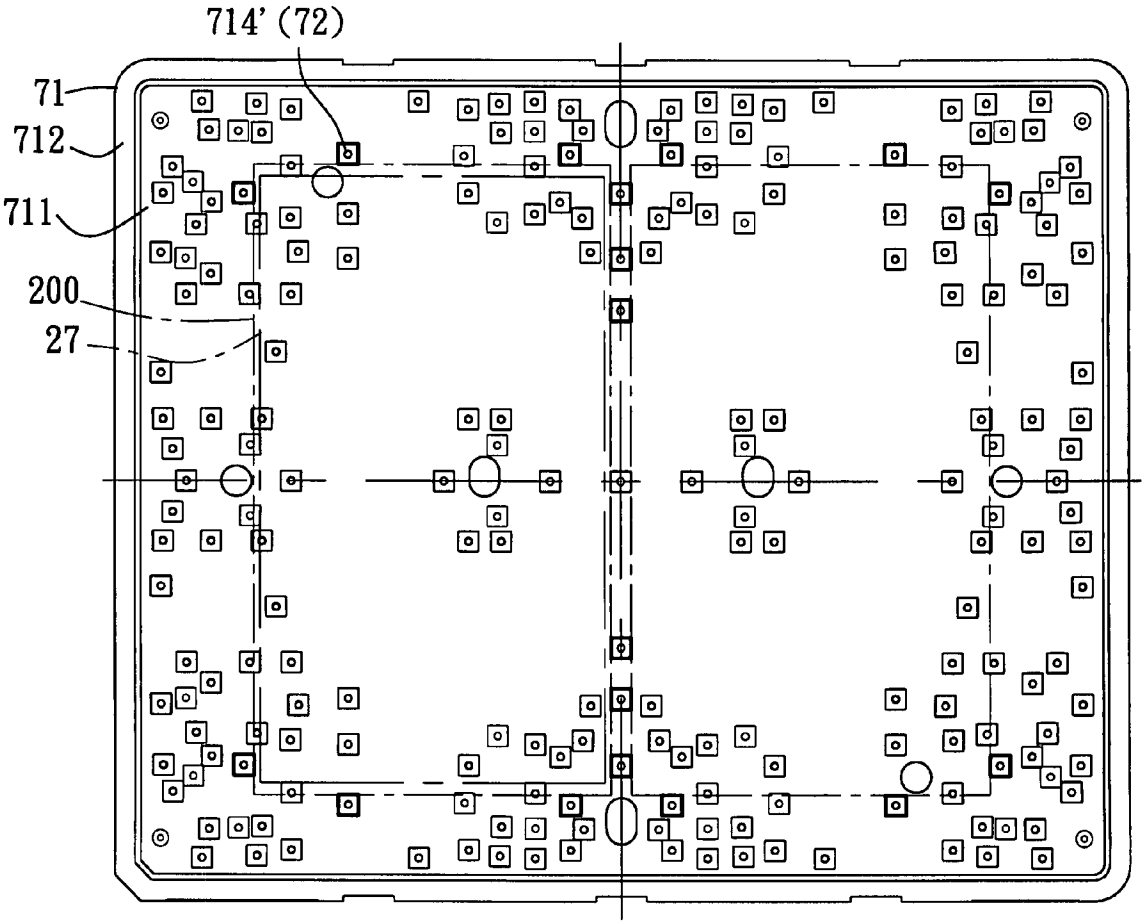
FIG. 16 is a schematic view to illustrate how a plurality of 27-inch display panels can be mounted in the box body of the box unit of the preferred embodiment according to this invention.

FIG. 16 illustrates how the inner box body 71 of each of the inner box units 7 accommodates two 27-inch display panels 27 (614.04 mm×351.96 mm) which are limited within the confining regions 200 of a respective one of the confining patterns by the limiting members 72.

Figure 17:
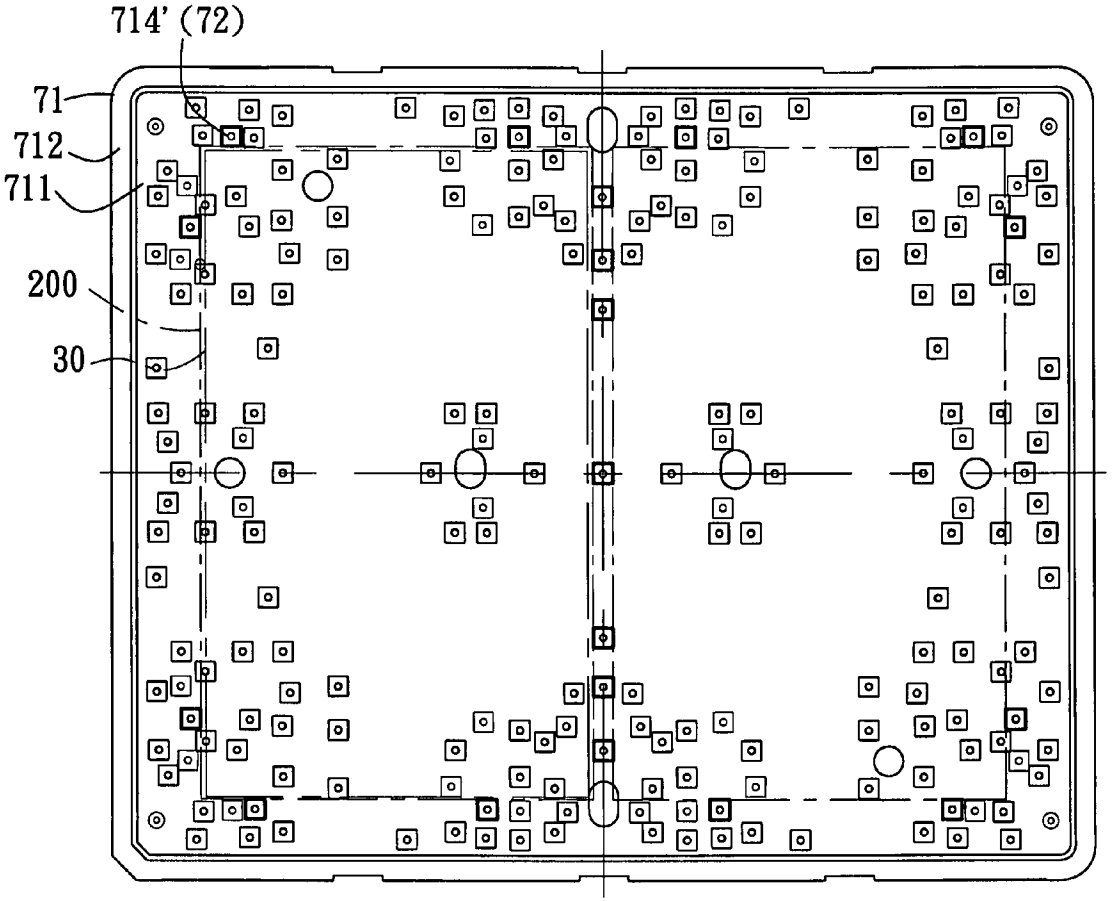
FIG. 17 is a schematic view to illustrate how a plurality of 30-inch display panels can be mounted in the box body of the box unit of the preferred embodiment according to this invention.

FIG. 17 illustrates how the inner box body 71 of each of the inner box units 7 accommodates two 30-inch display panels 30 (656.1 mm×398.82 mm) which are limited within the confining regions 200 of a respective one of the confining patterns by the limiting members 72.

Figure 18:
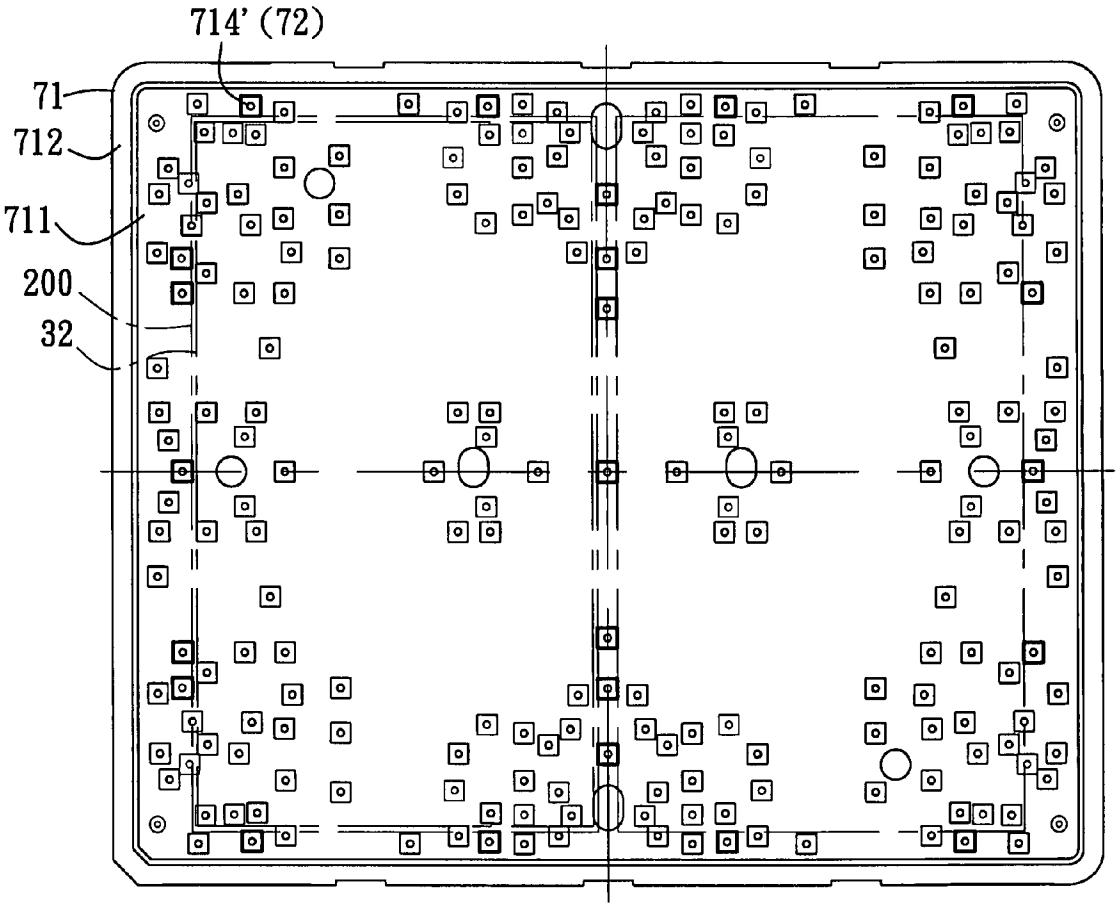
FIG. 18 is a schematic view to illustrate how a plurality of 32-inch display panels can be mounted in the box body of the box unit of the preferred embodiment according to this invention.

FIG. 18 illustrates how the inner box body 71 of each of the inner box units 7 accommodates two 32-inch display panels 32 (713 mm×408.8 mm) which are limited within the confining regions 200 of a respective one of the confining patterns by the limiting members 72.

Figure 19:
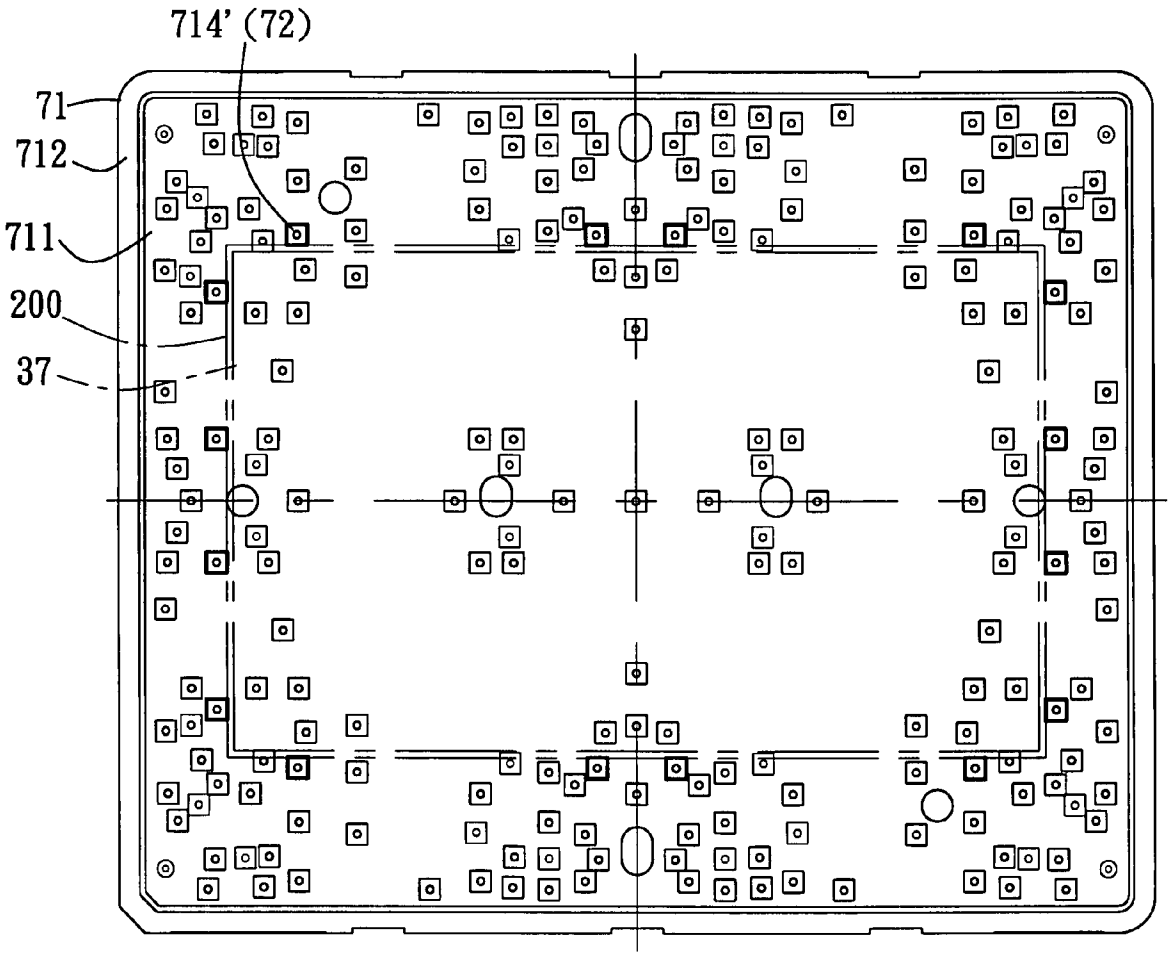
FIG. 19 is a is a schematic view to illustrate how a 37-inch display panel can be mounted in the box body of the box unit of the preferred embodiment according to this invention.

FIG. 19 illustrates how the inner box body 71 of each of the inner box units 7 accommodates one 37-inch display panel 37

(837.8 mm×476.5 mm) which is limited within the confining region 200 of a respective one of the confining patterns by the limiting members 72.

Figure 20:
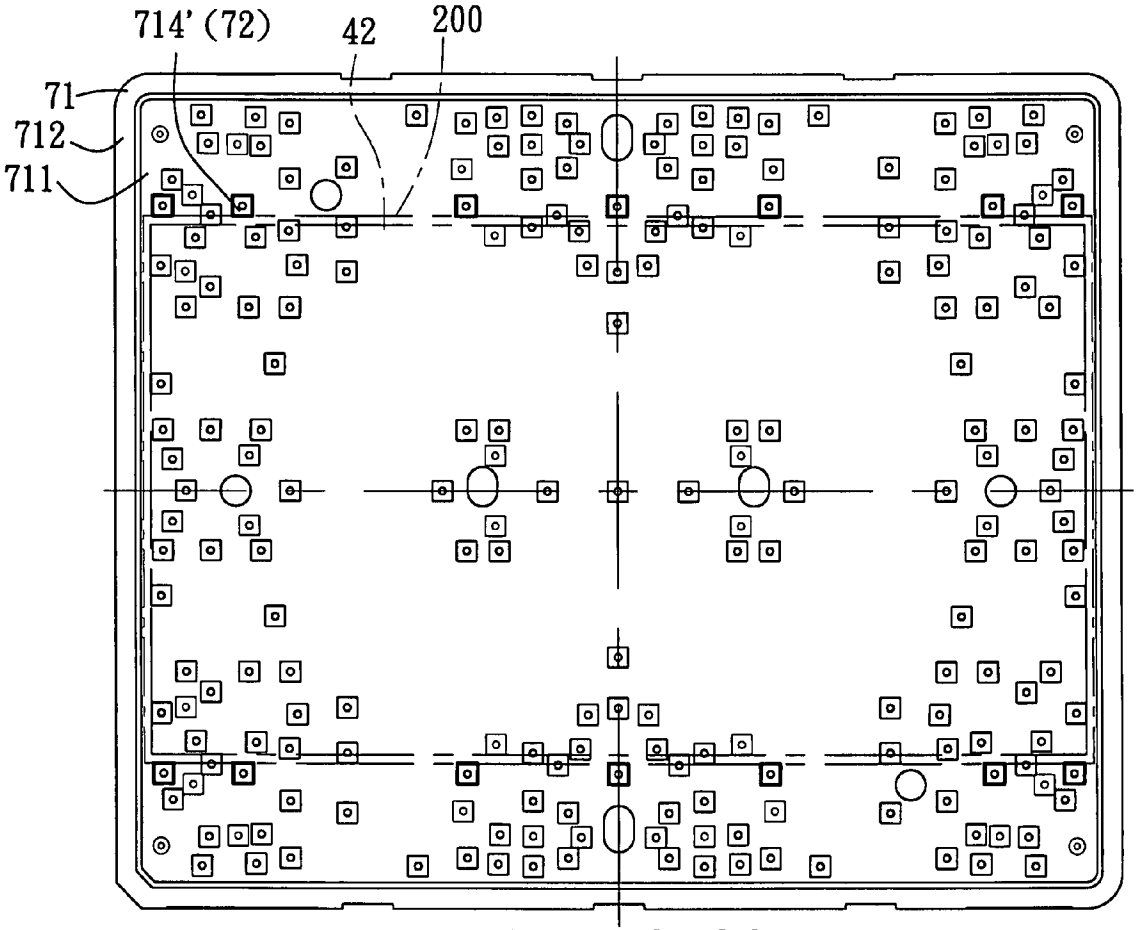
FIG. 20 is a schematic view to illustrate how a 42-inch display panel can be mounted in the box body of the box unit of the preferred embodiment according to this invention.

FIG. 20 illustrates how the inner box body 71 of each of the inner box units 7 accommodates one 42-inch display panel 42 (944.36 mm×538.64 mm) which are limited within the confining regions 200 of a respective one of the confining patterns by the limiting members 72.

Figure 21:
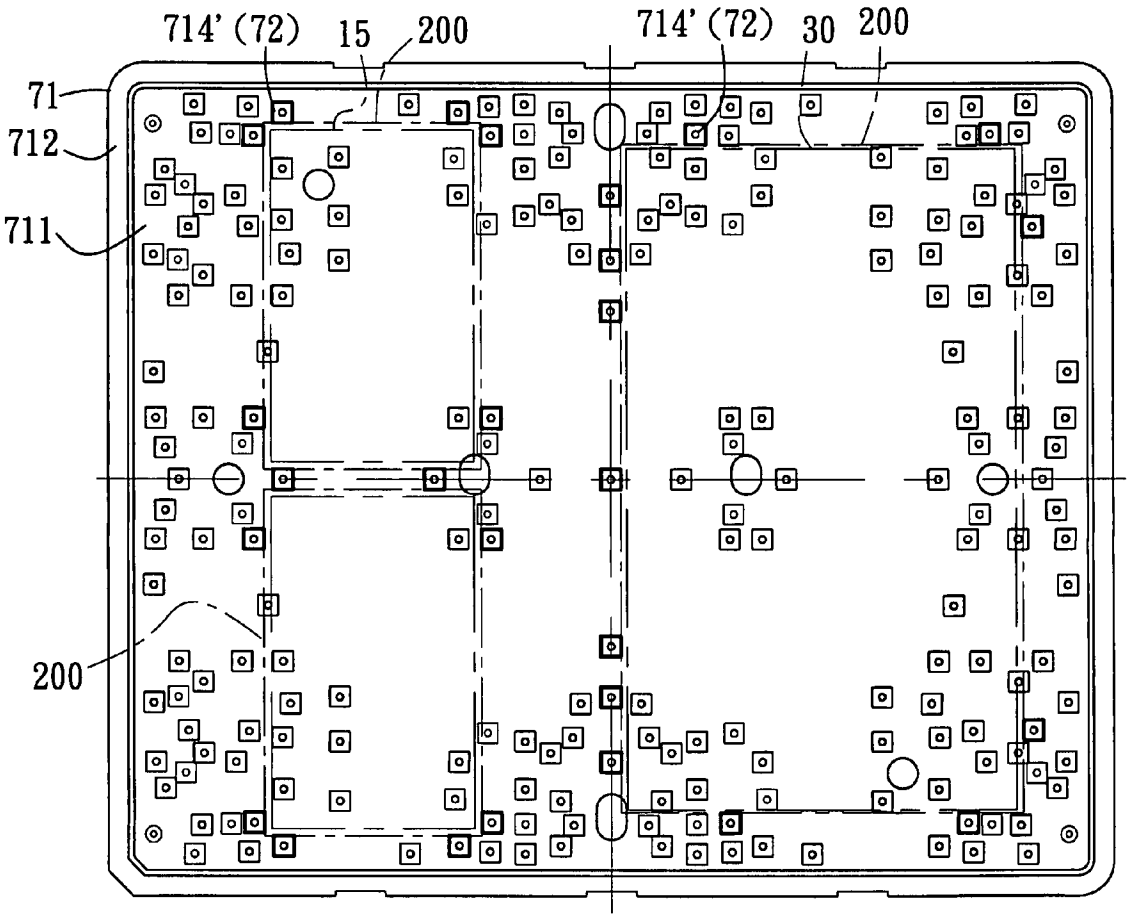
FIG. 21 is a schematic view to illustrate how a 30-inch and two 15.4-inch display panels can be mounted in the box body of the box unit of the preferred embodiment according to this invention.

FIG. 21 illustrates how the inner box body 71 of each of the inner box units 7 accommodates two 15.4-inch display panels 15 and one 30-inch display panel 30 which are limited within the confining regions 200 of a respective one of the confining patterns by the limiting members 72.

Figure 22:
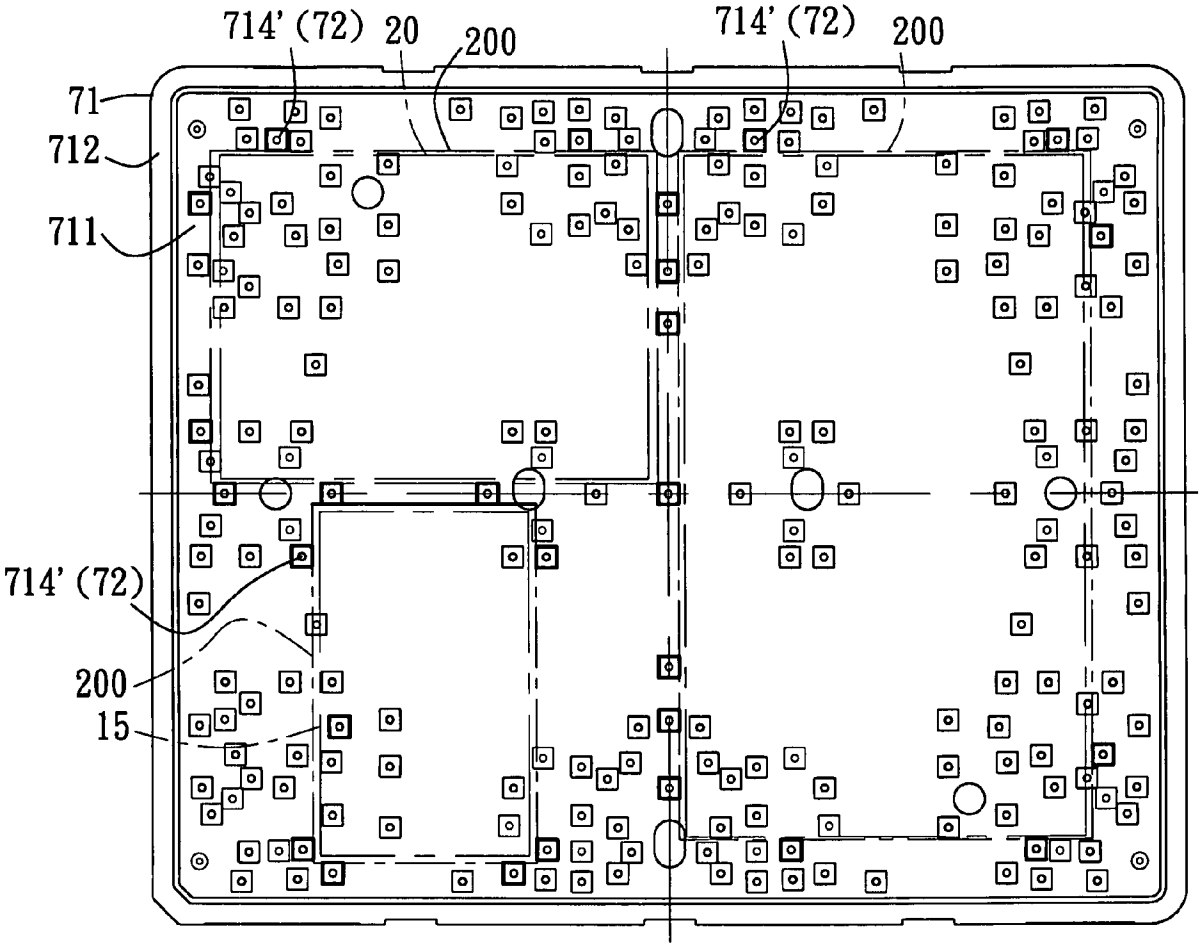
FIG. 22 is a schematic view to illustrate how a 30-inch, a 20-inch, and a 15.4-inch display panels can be mounted in the box body of the box unit of the preferred embodiment according to this invention.

FIG. 22 illustrates how the inner box body 71 of each of the inner box units 7 accommodates one 15.4-inch display panel 15, one 20-inch display panel 20, and one 30-inch display panel 30 which are limited within the confining regions 200 of a respective one of the confining patterns by the limiting members 72.

By virtue of the positioning elements 714' and the limiting members 72 of the box assembly of this invention, the aforesaid drawback associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A box assembly comprising:

an outer box unit including an outer box body with an inner wall surface that is formed with two opposite rows of ribs defining a plurality of box-receiving spaces thereamong; and a plurality of inner box units, each of which is received in a respective one of said box-receiving spaces, and each of which includes a box body and having a top opening, a base wall opposite to said top opening and formed with a plurality of spaced apart through holes, and a peripheral wall extending from said base wall to said top opening, said through holes defining a plurality of confining regions;

at least two cushioning pads disposed between said cover and said base wall and adapted to sandwich at least one panel therebetween, each of said cushioning pads having a plurality of through holes aligned with said through holes of said base wall; and a plurality of spaced apart limiting members that are inserted detachably and respectively into selected ones of said through holes of said base wall which define at least one of said confining regions adapted to confine the panel and that extend through said through holes of each of said cushioning pads which are aligned with said selected ones of said through holes of said base wall, said limiting members being adapted to limit the panel from moving in a direction parallel to said base wall and said cushioning pads, wherein each of said ribs has a T-shaped cross-section.

2. A box assembly comprising:

an outer box unit including an outer box body with an inner wall surface that is formed with two opposite rows of ribs defining a plurality of box-receiving spaces thereamong; and a plurality of inner box units, each of which is received in a respective one of said box-receiving spaces, and each of which includes a box body and having a top opening, a base wall opposite to said top opening and formed with a plurality of spaced apart through holes, and a peripheral wall extending from said base wall to said top opening, said through holes defining a plurality of confining regions;

at least two cushioning pads disposed between said cover and said base wall and adapted to sandwich at least one panel therebetween, each of said cushioning pads having a plurality of through holes aligned with said through holes of said base wall; and a plurality of spaced apart limiting members that are inserted detachably and respectively into selected ones of said through holes of said base wall which define at least one of said confining regions adapted to confine the panel and that extend through said through holes of each of said cushioning pads which are aligned with said selected ones of said through holes of said base wall, said limiting members being adapted to limit the panel from moving in a direction parallel to said base wall and said cushioning pads, wherein said outer box unit further includes a cushioning member that is attached to said inner wall surface of said outer box body.

* * * * *